US006138299A

United States Patent [19]

Roma et al.

[11] Patent Number: 6,138,299

[45] Date of Patent: Oct. 31, 2000

[54] AUTOMATIC FUTON FRAME

[75] Inventors: John K. Roma, Orchard Park; James D. Stuart, Hamburg, both of N.Y.

[73] Assignee: Otis Bed Manufacturing Co., Inc., Buffalo, N.Y.

[21] Appl. No.: 09/267,457

[22] Filed: Mar. 12, 1999

Related U.S. Application Data

[63] Continuation-in-part of application No. 09/080,067, May 15, 1998, Pat. No. 6,061,848, which is a continuation-in-part of application No. 08/924,896, Sep. 8, 1997, Pat. No. 5,790,993.

[51] Int. Cl.[7] ..... A47C 17/17; A47C 17/04

[52] U.S. Cl. ..... 5/37.1; 5/41; 5/47; 5/927

[58] Field of Search ..... 5/37.1, 41, 47, 5/915, 927

[56] References Cited

U.S. PATENT DOCUMENTS

| | | | |
|---|---|---|---|
| 2,321,206 | 6/1943 | Holcomb | 5/47 |
| 4,105,024 | 8/1978 | Raffel | 5/915 X |
| 5,129,114 | 7/1992 | Withers . | |
| 5,140,977 | 8/1992 | Raffel | 5/915 X |
| 5,628,076 | 5/1997 | Newton | 5/37.1 |
| 5,664,268 | 9/1997 | Stoler et al. | 5/37.1 |
| 5,790,993 | 8/1998 | Roma et al. | 5/37.1 |
| 5,815,858 | 10/1998 | Dodge | 5/37.1 |
| 5,940,907 | 8/1999 | Stoler et al. | 5/37.1 |
| 5,956,785 | 9/1999 | Fireman | 5/37.1 |
| 6,061,848 | 5/2000 | Roma et al. | 5/37.1 |

*Primary Examiner*—Terry Lee Melius
*Assistant Examiner*—Robert G. Santos
*Attorney, Agent, or Firm*—Simpson, Simpson & Synder, L.L.P.

[57] ABSTRACT

A futon frame includes a pair of linear actuators mounted at opposing sides thereof for driving a folding seat and back of the frame to automatically and continuously adjust the seat and back between a sofa position and a bed position. The back is connected to opposing sides of the frame by upper and lower follower bearings arranged for travel within corresponding upper and lower guide channels in each opposing side of the frame. A motor controller is mounted to the underside of the seat for connecting a user interface to the linear actuator motors.

4 Claims, 5 Drawing Sheets

FIG. 9
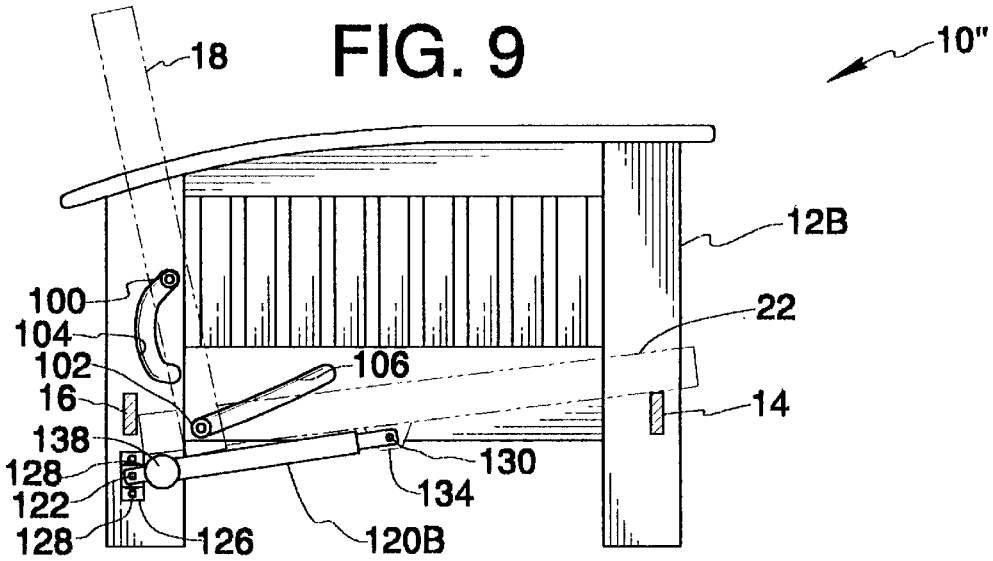
FIG. 10
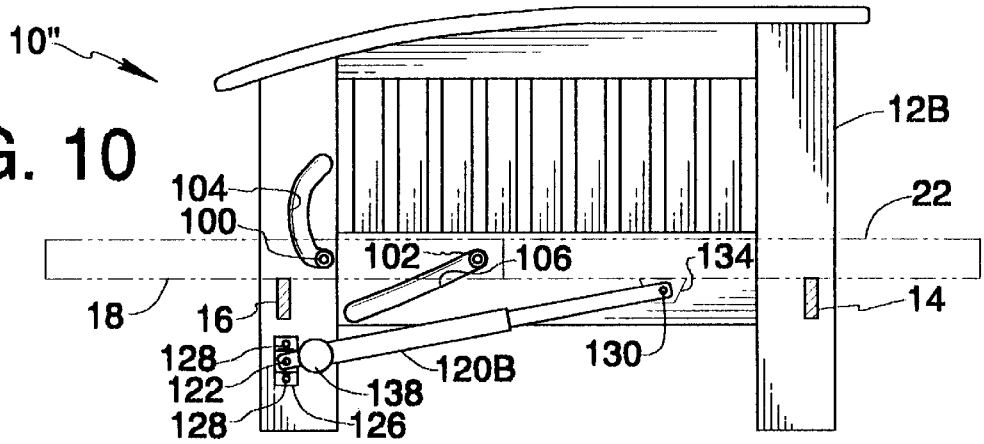
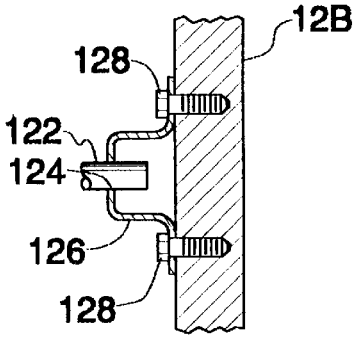
FIG. 11
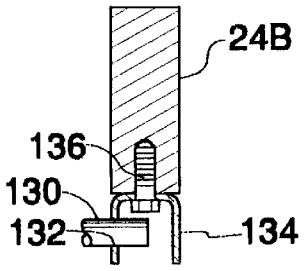
FIG. 12

AUTOMATIC FUTON FRAME

CROSS-REFERENCE TO RELATED APPLICATIONS

This application is a continuation-in-part of application Ser. No. 09/080,067 filed on May 15, 1998 now U.S. Pat. No. 6,061,848, which is a continuation-in-part of application Ser. No. 08/924,896 filed Sep. 8, 1997, now U.S. Pat. No. 5,790,993.

BACKGROUND

A. Field of the Invention

The present invention relates generally to sofa-bed frames for adjustably supporting a futon mattress, and more particularly to a futon mattress frame having seat and back portions automatically adjustable between a sofa position and a bed position.

B. Description of the Prior Art

Manually operated futon frames having a seat and a back linked to the seat for guided relative motion to permit adjustment between a sofa position and a bed position are well known in the art. In a common futon frame arrangement, the seat and back are pivotally connected to each other, and the back is connected to each adjacent side of the frame by respective link arms having one end pivotally connected to the back and another end pivotally connected to the associated side of the frame. In another common arrangement, pairs of follower bearings extend from the back for travel within corresponding pairs of guide channels provided in each side of the frame. With either type of arrangement, manual adjustment from a sofa position to a bed position is made by sliding the seat forward such that back is caused to follow and assume a horizontal position level with the seat. Manual adjustment from a bed position to a sofa position is carried out by pushing the seat backward at a slight downward angle to force the back into a generally vertical position. U.S. Pat. No. 5,129,114 illustrates this type of construction.

Heretofore, various attempts have been made to automate the adjustment operation of futon frames by providing a single stationary drive motor as means for indirectly driving a follower bracket connected to impart adjustment motion to the seat and back. Examples may be seen in U.S. Pat. Nos. 3,458,877; 4,563,784; and 4,937,900.

A primary challenge encountered in the design of an automatically adjustable futon frame is that of providing means for moving the seat and back from their flat bed position to their angled sofa position against the natural force of gravity. More particularly, a relatively large force is required to initiate backward movement of the seat to dislodge the back from its horizontal position. Prior art automatic frames have typically relied on complex multiple-bar linkages and/or brute power in the electric motor to meet this challenge. Drawbacks of a complex linkage system include added manufacturing cost, increased frame weight, and decreased reliability. Drawbacks of using a single high-powered motor include complexities in the drive train necessary to evenly transmit force to each side of the frame for smooth adjustment motion, with corresponding increase in manufacturing cost. Consequently, despite the long-recognized desirability of an automatically adjustable futon frame, as evidenced by the patents mentioned above, such item is not widely available to consumers at a reasonable price.

SUMMARY OF THE INVENTION

Therefore, it is an object of the present invention to provide an automatically adjustable futon frame which is both reliable and relatively inexpensive to manufacture.

It is a further object of the present invention to provide an automatically adjustable futon frame which adjusts smoothly even when individuals are seated or lying thereon.

In view of these and other objects, an automatically adjustable futon frame formed in accordance with a first embodiment of the present invention comprises a seat and back pivotally connected by a laterally extending hinge and situated between a pair of sides connected by laterally extending front and rear support members underlying the seat and back. A pair of link arms pivotally connect opposite side members of the back to respective sides of the frame.

Dual electric motors are fixed to opposite side members of the seat by mounting brackets, with each motor directly driving a pinion arranged to engage a downwardly facing inclined toothed rack of a rack member secured to an inner surface of the associated side of the frame. A follower pin is also fixed to the mounting bracket for following an upwardly facing inclined guide surface, preferably integral with the rack member, for maintaining drive engagement between the pinion and toothed rack over a predetermined range of travel. A pair of limit switches are arranged near opposite ends of one of the rack members for engagement by the pinion to signal a motor controller to shut-off power to both motors when the seat and back reach a sofa position or a bed position. The motor controller is preferably mounted to the underside of the seat, and a user interface panel for signaling the motor controller allows selective adjustment of the seat and back by a user.

A second embodiment of the present invention is similar to the first embodiment, except that the link arms pivotally connecting opposite side members of the back to respective sides of the frame are removed, and instead each opposite side member of the back is provided with an upper follower bearing and a lower follower bearing received within associated upper and lower guide channels formed in the corresponding side of the frame.

A third and presently preferred embodiment of the present invention is similar to the second embodiment, except that the motorized linear actuators are used in place of the motor driven pinions and inclined rack members at the frame sides. Each linear actuator includes a first end pivotally connected to an associated side of the frame below the laterally extending rear support member, and a second end pivotally connected to a respective side member of the seat. The second end of the linear actuator is telescopically movable relative to the first end by a motor near the first end which is operably connected to the motor controller.

BRIEF DESCRIPTION OF THE DRAWINGS

The nature and mode of operation of the present invention will now be more fully described in the following detailed description of the preferred embodiments taken with the accompanying drawing figures, in which:

FIG. 9 is a schematic view showing a third embodiment of the present invention, in its sofa position;

FIG. 10 is a schematic view similar to that of FIG. 9, however showing the frame in its bed position;

FIG. 11 is a cross-sectional view showing a support bracket used in the third embodiment; and FIG. 12 is a cross-sectional view showing another support bracket used in the third embodiment.

DETAILED DESCRIPTION OF THE PREFERRED EMBODIMENTS

Figure 1:
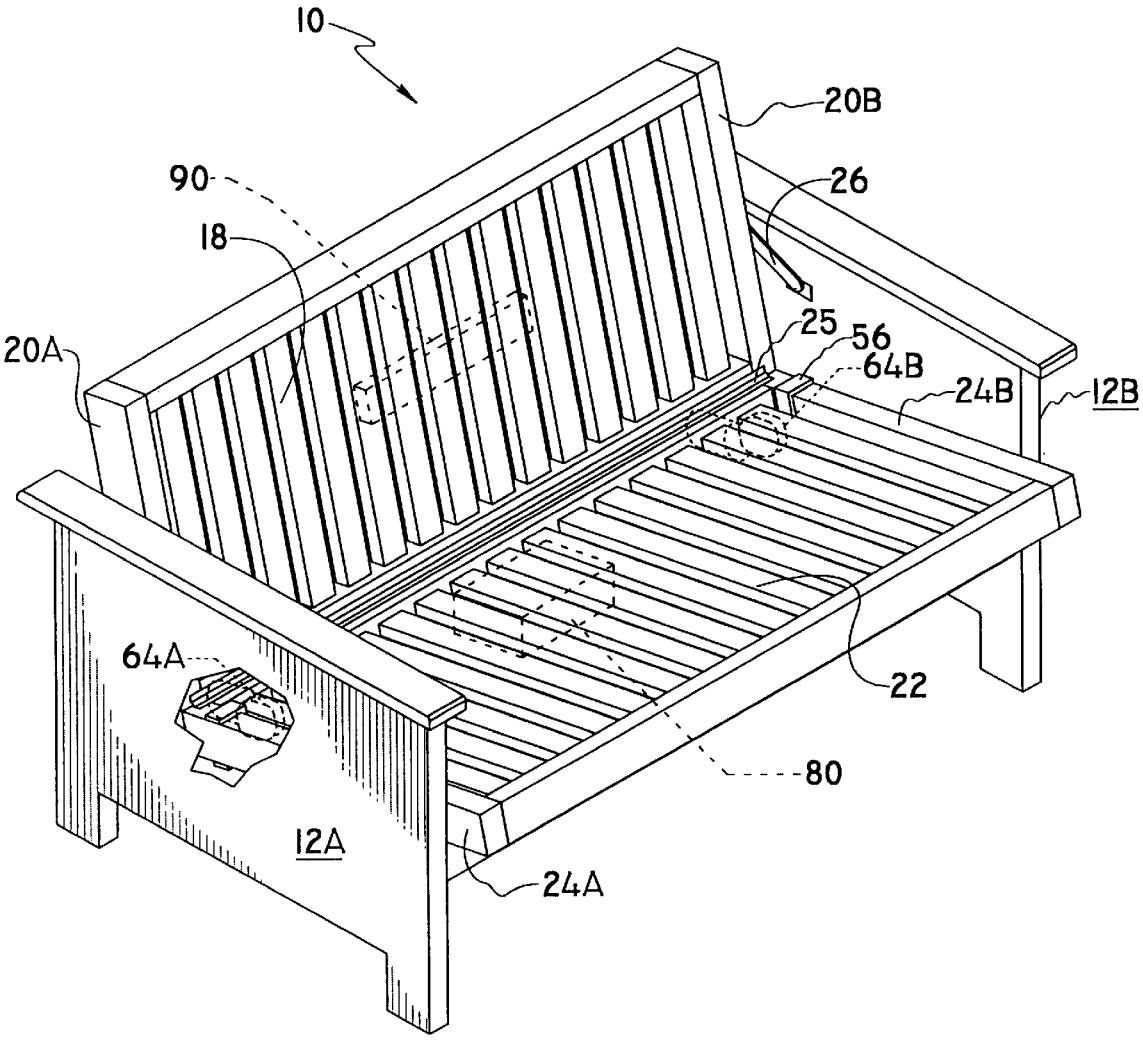
FIG. 1 is an isometric view of a futon frame formed in accordance with a first embodiment of the present invention, in its sofa position.
Figure 2:
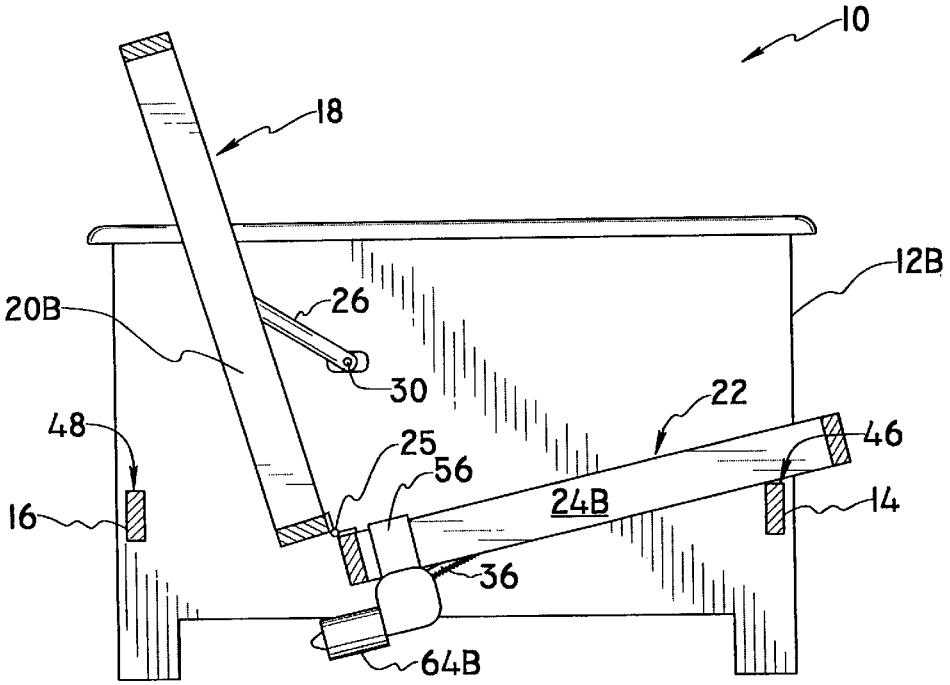
FIG. 2 is a sectional view showing one side of the futon frame depicted in FIG. 1.

Referring initially to FIGS. 1 and 2, a futon frame formed in accordance with a first embodiment of the present invention is shown and identified generally by the reference numeral 10. Futon frame 10 is structurally conventional to the extent that it includes a pair of opposite sides 12A,12B connected by a front support member 14 and a rear support member 16 extending laterally between sides 12A,12B; a rectangular back 18 situated between sides 12A,12B and having first and second side members 20A,20B near respective sides 12A,12B; a rectangular seat 22 situated between sides 12A,12B and having first and second side members 24A,24B near respective sides 12A,12B, and a hinge 25 fixed along adjacently matched laterally extending members of the back and seat, whereby the back and seat may be folded relative to each other along a laterally extending axis of hinge 25 between a sofa position, shown in FIGS. 1 and 2, and a bed position, shown in FIG. 3.

Figure 3:
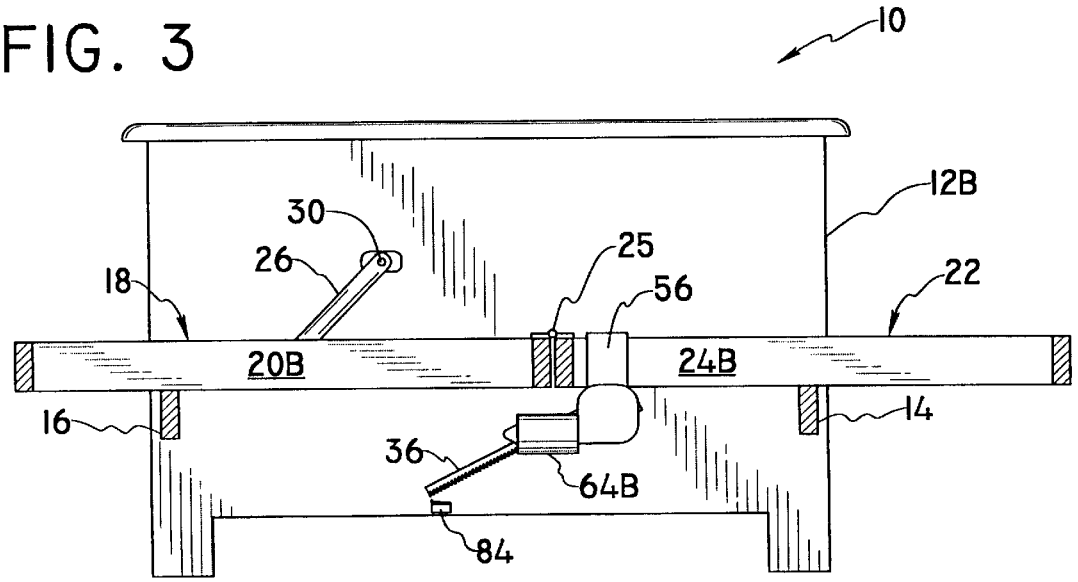
FIG. 3 is a view similar to that of FIG. 2, however the futon frame is adjusted to its bed position.
Figure 4:
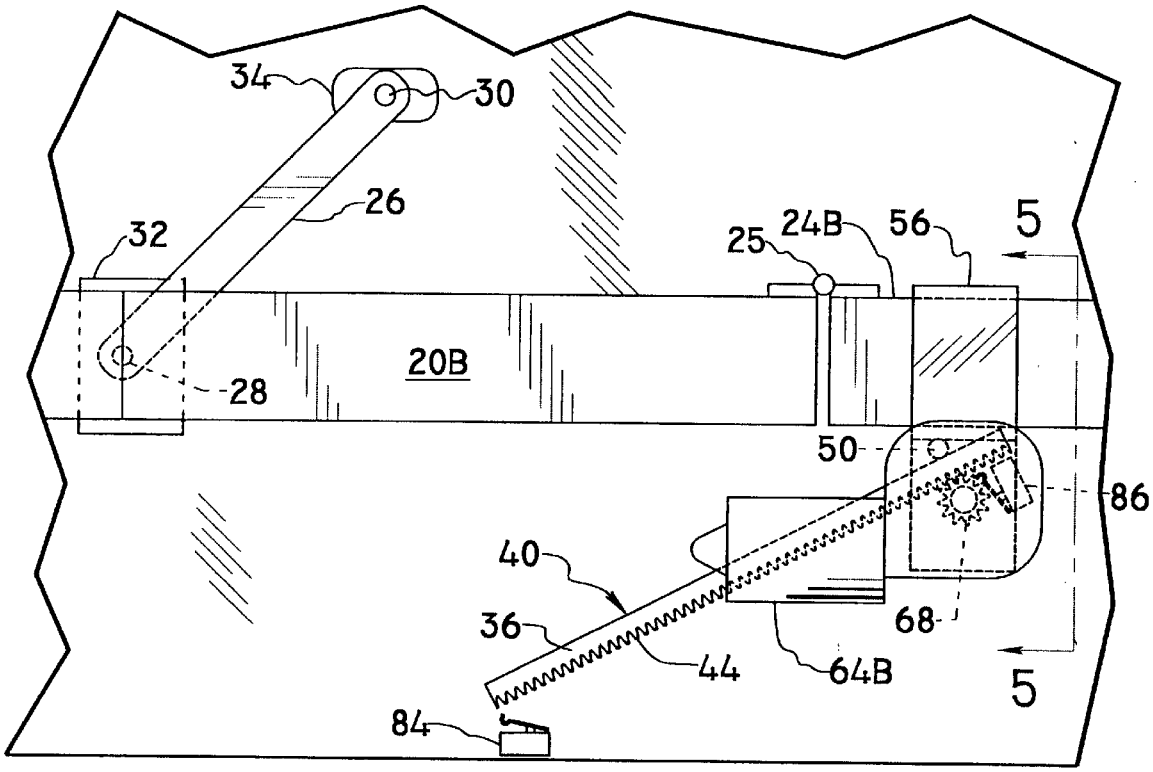
FIG. 4 is a partial view generally similar to that of FIG. 3, but enlarged to show the motor drive arrangement of the present invention in more detail.

Referring primarily now to FIGS. 2–4, it will be understood that structure described in general association with side 12B of frame 10 is also provided with respect to opposite side 12A in complementary fashion, whereby the present description is simplified by reference only to the structural elements respective of side 12B, and not to the corresponding structural elements respective of side 12A. Back 18 is connected to side 12B by an elongated rigid link arm 26 having one end pivotally connected to back side member 20B by a pivot pin 28 located at a substantially intermediate point along side member 20B, and an opposite end pivotally connected to side 12B by a pivot pin 30 located generally toward the rear of side 12B above front and rear support members 14 and 16. Where frame 10 is of wooden construction, a U-shaped metal reinforcement brace 32 is preferably provided to engage three-sides of back side member 20B about pivot pin 28, and a metal reinforcement plate 34 is preferably provided on side 12B about pivot pin 30.

A unitary rack member 36 is fixed to the inside surface of side 12B between front and rear support members 14 and 16 and includes an adjustment guide in the form of an upwardly facing straight guide surface 40, and rack means in the form of a downwardly facing toothed rack 44. While guide surface 40 and toothed rack 44 of the first embodiment are integrally incorporated into a unitary piece of stock material comprising rack member 36, a separately formed adjustment guide and rack means may also be employed without straying from the scope of the present invention. Rack member 36 is oriented at an incline relative to ground such that a front end thereof is higher than a rear end thereof and terminates approximately at a level corresponding to upper surfaces 46 and 48 of front and rear support members 14 and 16, respectively. As will be appreciated from coming description, guide surface 40 defines an inclined travel path, and toothed rack 44 defines an inclined drive path substantially parallel to the travel path.

Figure 5:
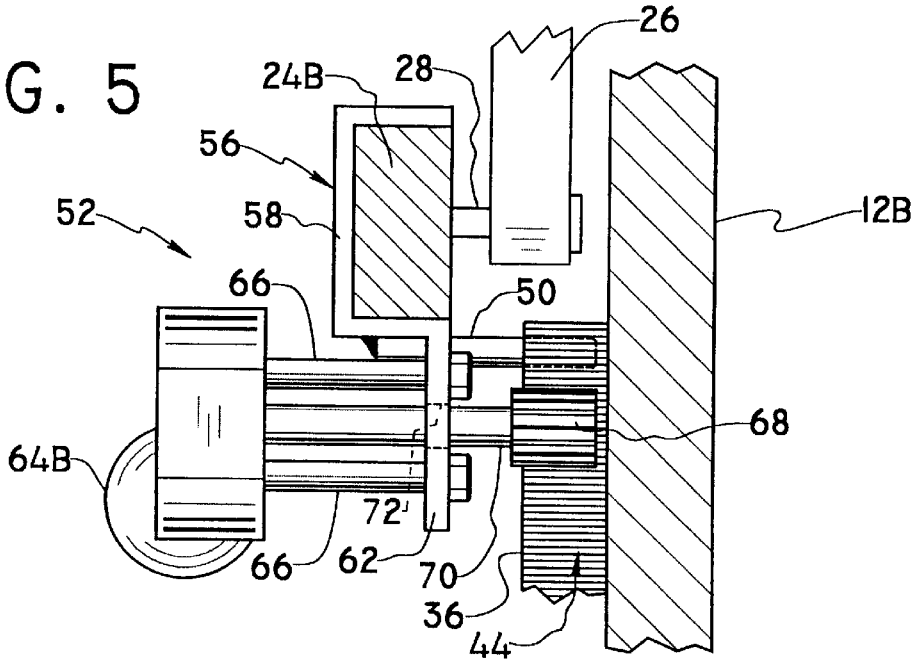
FIG. 5 is a view taken generally along the line 5—5 in FIG. 4.

Referring also now to FIG. 5, it will be seen that a follower pin 50 and automatic drive means 52 are associated with seat 22 for cooperation with adjustment guide surface 40 and toothed rack 44. Follower pin 50 is fixed relative to seat side member 24B adjacent an underside thereof by a mounting bracket 56 to which the follower pin may be welded such that it extends from the mounting bracket to engage guide surface 40. Mounting bracket 56 includes a U-shaped portion 58 secured to seat side member 24B generally proximate to hinge 25 by conventional fasteners (not shown). Mounting bracket 56 further includes a tail portion 62 extending downwardly from U-shaped portion 58 to which an electric motor 64B is attached by bolts 66. Electric motor 64B drives a pinion 68 arranged to mate with toothed rack 44 via a drive shaft 70 extending through an opening 72 provided in tail portion 62. A 24 Volt DC, 33 rpm motor manufactured by Dewert Motorized Systems, Inc. of Frederick, Maryland under part number 002.016 is known to be suitable for use in practicing the present invention, and is chosen to enable automatic adjustment even while individuals are supported by frame 10.

A motor controller 80 is mounted to the underside of seat 22 generally at the rear center thereof, as may be seen in FIG. 1. The Motor Master 1 controller, 115 Volts AC, 50/60 Hz, 230 Watt Max., Part No. 990.210.002 from Dewert Motorized Systems, Inc., is suitable. Motor controller 80 is wired to signal both electric motors 64A,64B simultaneously. As will be understood, the directions of rotation of motors 64A,64B must be oppositely set in view of the mirror-image arrangement of the motors. A hard-wired or remote control panel 82 is provided as known in the art to permit user interface with motor controller 80. A first limit switch 84 wired to controller 80 is fixed to side 12B near a lower end of rack member 36, such that driven pinion 68 engages the switch mechanism when seat 22 and back 18 reach their sofa position, thereby signaling controller 80 to shut-off driving current to motors 64A,64B. A similarly connected limit switch 86 is provided near an upper end of rack member 36 to be engaged by driven pinion 68 when seat 22 and back 18 reach their bed position.

As an added option, an automatic vibrating element 90 may be mounted to back 18 and wired to motor controller 80 to provide frame 10 with a desirable automatic massage feature.

During adjustment of frame 10, rotating pinion 68 travels along toothed rack 44 while follower pin 50 helps to support seat 22 and maintain pinion 68 in mating engagement with the toothed rack. While the changing orientation of seat 22 causes a corresponding change in the orientation of follower pin 50 and driven pinion 68 relative to rack member 36 due to rotation of mounting bracket 56, the problem of binding is effectively avoided by locating the centers of follower pin 50 and driven pinion 68 at such an orientation that an imaginary line extending between the centers will be normal to guide surface 40 and toothed rack 44 when the pinion is midway between the ends of the toothed rack during travel, this being the condition of proper alignment between the rack and pinion. The most severe misalignment occurs when the pinion is at either of its travel limits near the ends of rack 44, thereby splitting the magnitude of misalignment between the ends rather than concentrating misalignment at one end or the other. In this way, slight misalignment at the travel limits may be disregarded in view of normal "play" between rack and pinion. Of course, a specially designed rack member having an arcuate toothed rack may be employed to eliminate binding, however this would increase cost. Finally, link arm 26 enables pivoting reactive adjustment of back 18 in response to movement of hinge 25 as seat 22 is automatically adjusted. The user may stop automatic adjustment at any point between the sofa and bed positions, as desired.

Figure 6:
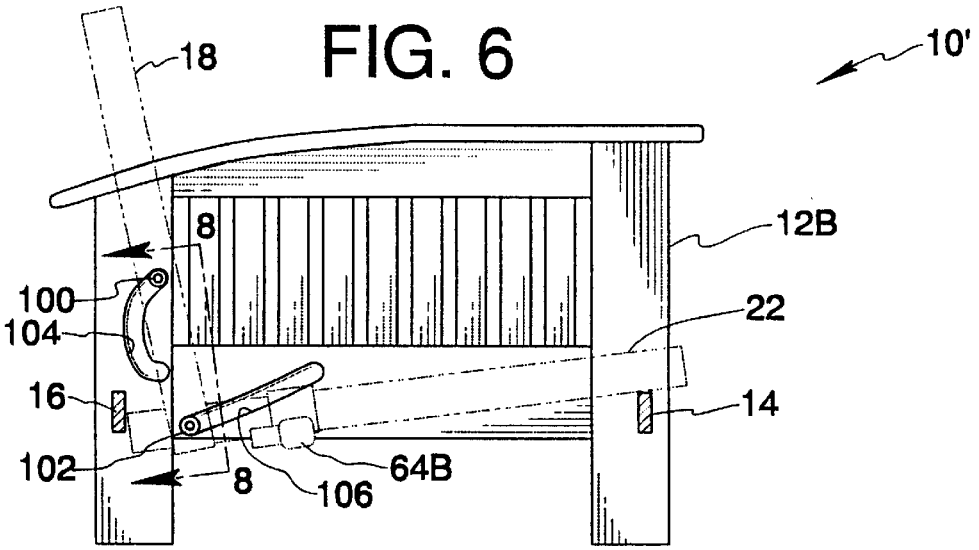
FIG. 6 is a schematic view showing a second embodiment of the present invention, in its sofa position.
Figure 7:
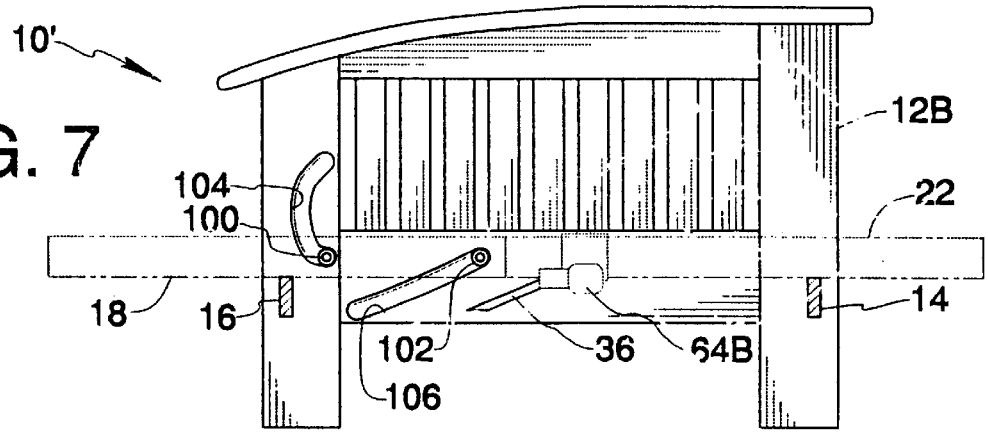
FIG. 7 is a schematic view similar to that of FIG. 6, however showing the frame in its bed position.
Figure 8:
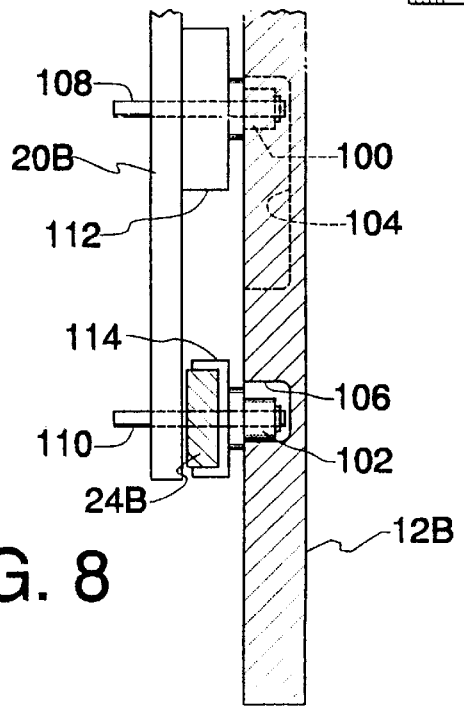
FIG. 8 is a sectional view taken generally along the line 8—8 in FIG. 6.

A futon frame 10' formed in accordance with a second embodiment of the present invention will be understood with reference to FIGS. 6 through 8. Frame 10' is similar to the first embodiment described above, except in its manner of connection between back 18 and sides 12A,12B. Back side members 20A,20B are each provided with an upper follower bearing 100 arranged for travel within a contoured upper guide channel 104 formed in an adjacent one of the opposing sides 12A,12B, and also a lower follower bearing 102 arranged for travel within a contoured lower guide channel 106 formed in the adjacent side 12A or 12B.

FIG. 8 shows upper and lower stepped follower bearings 100 and 102 connected to back side member 20B by corresponding upper and lower transversely extending pivot pins 108 and 110. A spacer block 112 is provided between back side member 20B and upper follower bearing 100. Lower pivot pin 110 connects lower follower bearing 102 to back side member 20B, and further provides a pivotal connection between back 18 and seat 22 to replace hinge 25 of the first embodiment, whereby lower follower bearing 102 is coaxial with a transverse pivot axis between back 18 and seat 22. As is apparent, any rear transverse cross-member connecting seat side members 24A and 24B must be moved forward to allow space for overlapped pivoting between back 18 and seat 22. A metal support bracket 114 is located about seat side member 24B as reinforcement at the location where lower pivot pin 110 passes through seat side member 24B. Of course, a corresponding construction is provided with respect to side 12A.

The construction of the second embodiment greatly reduces or eliminates the need for support of the seat by means of follower pin 50 engaging guide surface 40, and also eliminates the need for link arms 26, which may loosen over time.

A third embodiment of the present invention is now described with reference to FIGS. 9–12 and is identified generally as 10". Frame 10" resembles frame 10' of the second embodiment in its use of upper follower bearings 100 arranged for travel within contoured upper guide channels 104 and lower follower bearings 102 arranged for travel within contoured lower guide channels 106. However, in frame 10" of the third embodiment, the automatic drive arrangement is different. More specifically, motorized linear actuators are provided to automatically move back 18 and seat 22 through the range of travel between their sofa and bed positions. FIGS. 9 and 10 show a linear actuator 120B associated with side 12B, it being understood that another linear actuator is associated in corresponding fashion with opposite side 12A, but is not shown for sake of simplicity. Linear actuator 120B includes a first end pivotally connected to side 12B below rear support member 16 by a pivot pin 122 received within a central mounting hole 124 in a generally U-shaped support bracket 126 fixed at its opposite ends to extend laterally inward from side 12B by fasteners 128 (see FIG. 11). A second, opposite end of linear actuator 120B is pivotally connected to respective side member 24B of seat 22 by a pivot pin 130 received within a central mounting hole 132 in another U-shaped support bracket 134 fixed to depend downwardly from side member 24B by fasteners 136 (see FIG. 12). Linear actuator 120B further includes automatic drive means in the form of an electric motor 138 operatively connected to motor controller 80 for automatically and reversibly changing the telescopic displacement between the first and second ends of linear actuator 120B. As may be seen in FIGS. 9 and 10, linear actuator 120B is chosen and arranged such that back 18 and seat 22 are in their sofa position when linear actuator 120B is fully retracted, and back 18 and seat 22 are in their bed position when linear actuator 120B is fully extended. Of course, linear actuator may be stopped at any point between its fully retracted and extended conditions to provide a continuum of intermediate adjustment possibilities. It will be understood that linear actuator 120B could be connected to frame 10" in an opposite manner to that shown, i.e. with motor 138 proximate to the point of pivotal connection to seat side member 24B, to achieve a similar adjustment effect. In a present reduction to practice, linear actuators and a cooperating motor controller were obtained from Phoenix Mecano Inc. of Frederick, Md.

What is claimed is:

1. An automatically adjustable futon frame comprising:

first and second opposing sides connected by front and rear support members extending laterally therebetween, each of said first and second opposing sides having an upper guide channel and a lower guide channel formed therein;

a back situated between said first and second opposing sides, said back having first and second side members respectively adjacent to said first and second opposing sides, each of said first and second side members of said back including an upper follower bearing arranged for travel within said upper guide channel of said adjacent opposing side and a lower follower bearing arranged for travel within said lower guide channel of said adjacent opposing side, a seat pivotally connected to said back for folding along a laterally extending axis, said seat having first and second side members, first and second linear actuators respectively coupled one to each of said first and second opposing sides and arranged to adjust said back and seat relative to each other between a sofa position and a bed position, said first and second linear actuators having automatic drive means, wherein each of said first and second linear actuators is pivotally mounted at a first end thereof to a respective side of said frame and pivotally mounted at a second end thereof to said seat, and said automatic drive means changes the displacement between the first and second ends; and controller means connected to said automatic drive means for enabling user operation of said first and second linear actuators.

2. The futon frame according to claim 1, wherein said automatic drive means of each of said first and second linear actuators is located proximate to said first end of said linear actuator.

3. The futon frame according to claim 1, further comprising automatic vibrating means fixed to said back and connected to said controller means.

4. An automatically adjustable futon frame comprising:

first and second opposing sides connected by front and rear support members extending laterally therebetween, each of said first and second opposing sides having an upper guide channel and a lower guide channel formed therein;

a back situated between said first and second opposing sides, said back having first and second side members respectively adjacent to said first and second opposing sides, each of said first and second side members of said back including an upper follower bearing arranged for travel within said upper guide channel of said adjacent opposing side and a lower follower bearing arranged for travel within said lower guide channel of said adjacent opposing side;

a seat pivotally connected to said back for folding along a laterally extending axis, said seat having first and second side members, and wherein said lower follower bearing is coaxial with said laterally extending axis;

first and second linear actuators respectively coupled one to each of said first and second opposing sides and arranged to adjust said back and seat relative to each other between a sofa position and a bed position, said first and second linear actuators having automatic drive means; and controller means connected to said automatic drive means for enabling user operation of said first and second linear actuators.

* * * * *